United States Patent [19]

Meenan et al.

[11] 4,109,850

[45] * Aug. 29, 1978

[54] FILE FOLDER WITH EXPANDABLE POCKET

[76] Inventors: Vincent D. Meenan, 25 Millbrook Dr., Middletown, N.J. 07748; Thomas P. Meenan, 3309 164th St., Flushing, N.Y. 11358

[ * ] Notice: The portion of the term of this patent subsequent to Jan. 20, 1993, has been disclaimed.

[21] Appl. No.: 742,300

[22] Filed: Nov. 16, 1976

[51] Int. Cl.[2] ..... B65D 27/08

[52] U.S. Cl. ..... 229/72; 40/359; 229/DIG. 3

[58] Field of Search ..... 229/DIG. 3, 1.5 R, 72; 40/359

[56] References Cited

U.S. PATENT DOCUMENTS

| | | | |
|---|---|---|---|
| 1,042,488 | 10/1912 | Shaffer | 229/DIG. 3 |
| 1,058,081 | 4/1913 | Montgomerie | 40/359 X |
| 1,194,440 | 8/1916 | Swortfiguer | 229/DIG. 3 |
| 1,774,215 | 8/1930 | Weinthrop | 229/68 R |
| 3,933,294 | 1/1976 | Meenan et al. | 229/72 X |

*Primary Examiner*—Stephen P. Garbe
*Attorney, Agent, or Firm*—Leo C. Krazinski

[57] ABSTRACT

A one-piece file folder for use in vertical, lateral, rotary and similar files having an improved expandable pocket with a locking tab that is slidable in accordance with the amount of papers disposed within the pocket.

9 Claims, 8 Drawing Figures

Fig. 4.
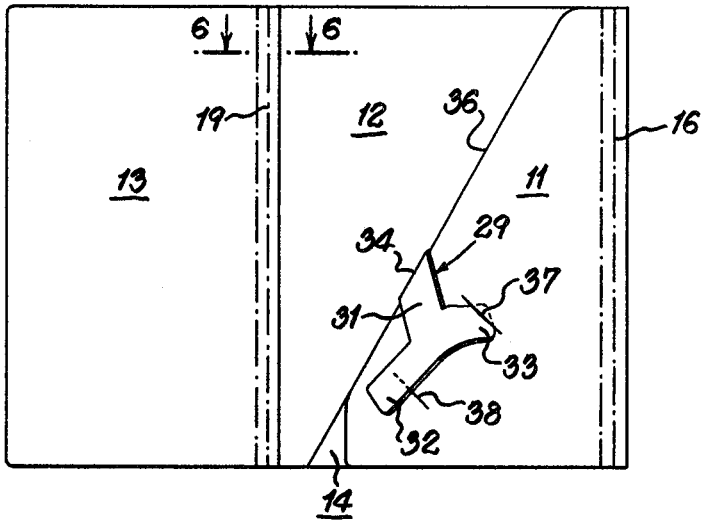
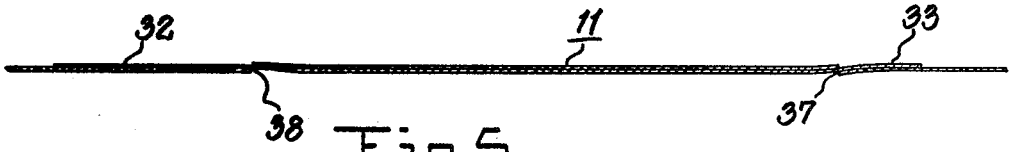
Fig. 5.
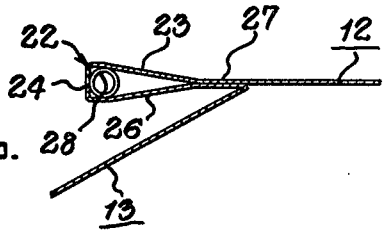
Fig. 6.
Fig. 7.
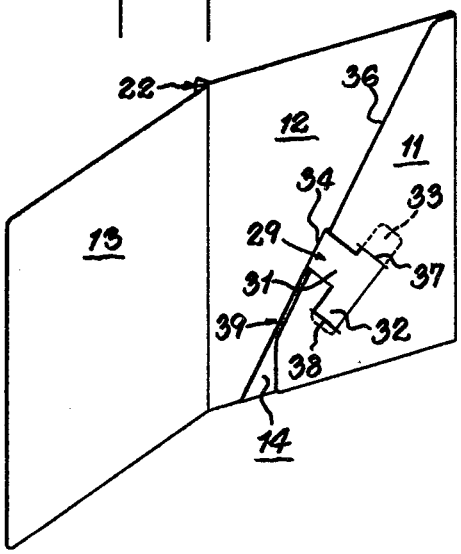
Fig. 8.
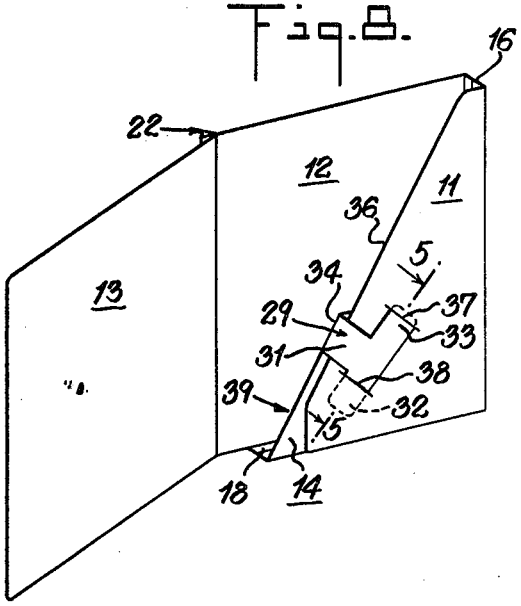

FILE FOLDER WITH EXPANDABLE POCKET

BACKGROUND OF THE INVENTION

1. Field of the Invention

The present invention relates to file folders and, more particularly, to improved one-piece folders arranged to be filed vertically or horizontally and having interlocking pockets that slidably expand or contract in accordance with the papers added or removed therefrom.

2. Description of the Prior Art

The most pertinent prior art is applicant's U.S. Pat. No. 3,933,294 wherein the expandable pocket is of the accordian type. A non-expandable pocket in a file folder is shown in U.S. Pat. No. 1,774,215.

SUMMARY OF THE INVENTION

Accordingly, an object of the present invention is to provide an improved file folder having a flexible, interlocking pocket.

Another object of the invention is to provide a flexible pocket in a file folder such that the pocket will expand and contract readily when filing material is added or removed therefrom.

A further object of the invention is to provide an improved file folder having an expandable pocket that is a sturdy and durable container for a substantial amount of filing material.

A still further object of the invention is to accomplish the foregoing objects in a simple, practical and economical manner.

In accordance with the present invention, the foregoing objects are generally accomplished by providing an expandable pocket in a folder that can be filed with its closed or spine side face out, or up, depending on the file in use. Accordingly, the essence of this invention resides in the expandable pocket as an improvement in applicant's U.S. Pat. No. 3,933,294, which includes a protruding tab on one element of the pocket that slides in slots provided in another element of the pocket, whereby both elements of the pocket are adjustably locked together to provide a substantial container for filing material disposed therein.

BRIEF DESCRIPTION OF THE DRAWINGS

A preferred embodiment of the invention has been chosen for purposes of illustration and description and is shown in the accompanying drawings, forming a part of the specification, wherein:

FIG. 4 is a top plan view showing the folder of FIG. 2 with its right flap folded to the left over the main body and with the upper protuberance of the bifurcated tab inserted into a slit provided in the right flap.

FIG. 5 is a sectional view taken along 5—5 on FIG. 8 showing both protuberances of the tab inserted into associated slits of the right flap.

FIG. 6 is an enlarged sectional view taken along 6—6 of FIG. 4 showing glued spine portion with tubular element inserted within spine opening for reinforcing the same.

FIG. 7 is a perspective view of the folder showing the positions of the protuberances in the slits and formation of the adjustable pocket during minimal displacement of the pocket.

FIG. 8 is a perspective view of the folder showing the position of the protuberances in the slits and formation of the adjustable pocket during substantially maximal displacement of the pocket.

DESCRIPTION OF PREFERRED EMBODIMENT

Figure 1:
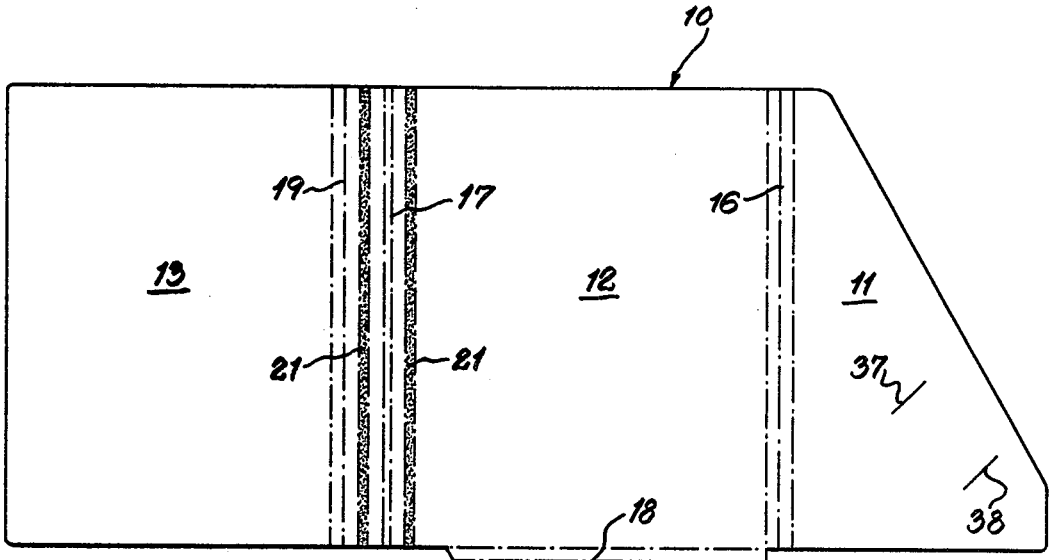
FIG. 1 is a top plan view of blank cut material for a folder showing score lines and stippled areas representing glue portions.

Referring now to FIGS. 1 to 8 of the drawings in detail, there is shown in FIG. 1 a flat sheet 10 of suitable folder material, such as oak tag stock or 1 ply Manila tag. As viewed in FIG. 1, the sheet is subdivided into four portions 11,12,13 and 14 by score lines 16,17,18 and 19, portions 11 and 14 to be used in forming a pocket and portions 12 and 13 for the back and front leaves, respectively, of the folder, as will appear hereinafter. Glue portions 21 are for securing contiguous portions 12 and 13 together.

Figure 2:
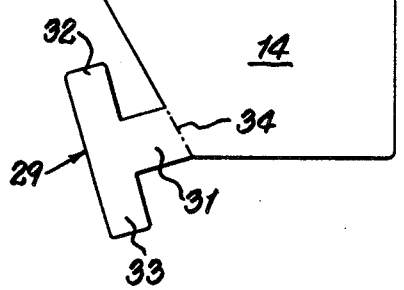
FIG. 2 is a top plan view of the folder of FIG. 1 showing the bottom flap with its tab folder upwardly over the main body of the folder and with glue portions sealed to provide the spine portion of the folder.
Figure 3:
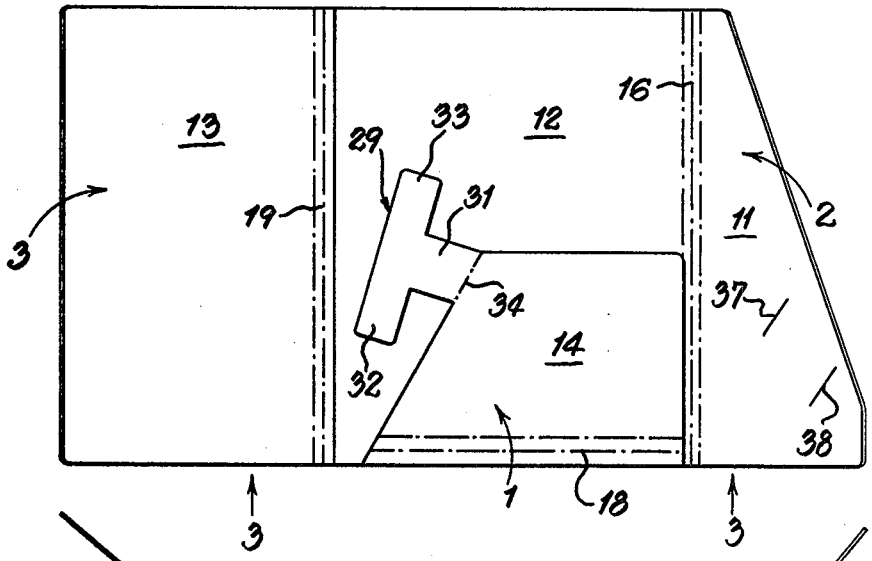
FIG. 3 is an end elevational view taken in the direction of the arrows 3—3 of FIG. 2.
Figure 3:
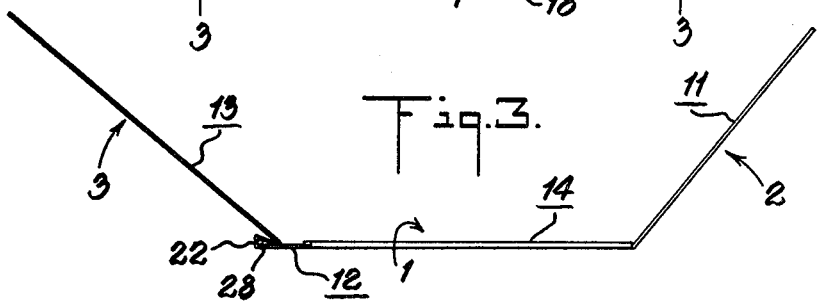

In assembling the folder, after the sheet 10 has been diecut, the first step is to score the lines 16,17,18 and 19 so as to provide accordian type expansion zones, after which the portion 14 is folded upwardly along the score lines 18 as viewed in FIGS. 2 and 3. For clarity, arrows 1,2 and 3 in FIGS. 2 and 3 indicate the order in which portions 14,11 and 13, respectively, are folded. Portion 11 is then folded along the score lines 16 to the left to overlap portion 14 to lay the basis for a pocket to be formed, as will be described hereinafter.

The next step is to prepare a spine 22 for the folder. This is done, see FIGS. 1, 3 and 6, by applying glue to both portions 21, folding the sheet 10 along the score lines 17 to secure the glued portions together and to form a triangular spine 22 in cross section, as seen particularly in FIG. 6 and also in FIGS. 3,7 and 8. The sheet 10 is then folded along the right edge of glued portion 21, as seen in FIG. 3, so that portion 13 is adhesively secured to portion 12 to thereby provide a reinforced spine 22, including sides 23, 24 and 26 (FIG. 6) forming the triangle and reinforcing glued leg 27. To additionally reinforce the spine 22 there is shown a tubular element 28, preferably of plastic material.

To return to formation of the pocket for the folder, portion 14 is formed with a tab 29 extending, as seen in FIG. 1, from the lower left corner thereof. This tab 29 includes a neck 31, extending from portion 14, and bifurcated protuberances 32 and 33. When the portion 14 is folded upwardly to the position shown in FIG. 2, the respective positions of the protuberances 32 and 33 are reversed. With the right portion 11 folded to the left and over portion 14, as already described, the pocket is formed, see FIG. 4, by folding the tab 29 along its junction line 34 with portion 14 over the left edge 36 of portion 11 and the protuberance 33 inserted through a slit 37 provided in portion 11. As seen in FIG. 7, the other protuberance 32 of tab 29 is inserted through a second slit 38 provided in portion 11, to complete formation of an adjustable pocket 39.

It is to be noted that the protuberances 32,33 are slidable in their respective slits 38,37 and their penetration through the slits is in accordance with the amount of material (not shown) deposited into the pocket 39. When the amount of material is comparatively small, FIG. 7 shows the disposition of the tab protuberances, while FIG. 8 shows the pocket 39 expanded for a substantial amount of material to be placed therein, with the socre lines 16,18 of portions 11 and 14 assisting in the expansion. As presently constituted, the expanded pocket 39 is adapted to hold the weight of about 1 inch of filing material. Also, it is to be noted that, when the file folder expands to its limit, the tab 29 forms a secure lock for the material within the folder. Of course, referring again to FIGS. 7 and 8, the left portion 13 is folded over the portions 11,12 and 14 to close the folder for filing purposes.

From the foregoing description, it will be seen that the present invention provides an improved folder, particularly including its expandable pocket, which safely and securely holds papers, pamphlets, a book, or other materials over one inch thick.

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. In a file folder formed from a single flat sheet having a front leaf, a back leaf, a side leaf and a bottom leaf extending from said back leaf in which a pocket for containing filing material is formed by the back, side and bottom leaves and in which upper edges of said front, back, side and bottom leaves are open and exposed for permitting ready insertion and withdrawal of papers, the improvement which comprises slidable means including a T shaped tab on said bottom leaf, said bottom leaf being folded over said back leaf, and guiding means having spaced slits for said sliding means on said side leaf for adjustably arranging said pocket, said side leaf being folded over said bottom leaf and also over said back leaf, said T shaped tab being folded over a side edge of said side leaf for mesh engagement of said tab with said slits whereby, when said tab and slits are interconnected, said pocket can be expanded or contracted as filing material is added to or removed from said pocket.

2. In the file folder of claim 1, wherein said T shaped tab includes an elongated neck, portion extending from a side of said bottom leaf and a pair of protuberances extending from said neck portion, said protuberances being at right angles to said neck portion.

3. In the file folder of claim 2, wherein said neck portion extends from the side of said bottom leaf at an acute angle and is adapted to overlay said side leaf.

4. In the file folder of claim 3, wherein said bottom leaf side is in substantial alignment with a side of said side leaf.

5. In the file folder of claim 4, wherein said spaced slits are substantially parallel with side edges of said neck portion when laid over said side leaf.

6. In the file folder of claim 5, wherein each of said protuberances of said tab is slidably disposed in said slits with said tab overlaying said side leaf.

7. In the file folder of claim 6, wherein said bottom leaf and said side leaf include a plurality of score lines for enabling said pocket to expand while said protuberances are slidably engageable in said slits.

8. In the file folder of claim 1, wherein a rigid triangular spine is formed at the juncture of said front leaf and back leaf.

9. In the file folder of claim 8, wherein a tubular element is disposed in said triangular spine for reinforcing said spine.

* * * * *